US007520591B2

(12) United States Patent
Suzuki

(10) Patent No.: US 7,520,591 B2
(45) Date of Patent: Apr. 21, 2009

(54) INKJET PRINTHEAD WITH SANDWICHED NOZZLE FILM AND METHOD OF MANUFACTURING THE SAME

(75) Inventor: Yoshihumi Suzuki, Ena (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 430 days.

(21) Appl. No.: 11/231,254

(22) Filed: Sep. 20, 2005

(65) Prior Publication Data

US 2006/0061622 A1 Mar. 23, 2006

(30) Foreign Application Priority Data

Sep. 22, 2004 (JP) ..... 2004-274457

(51) Int. Cl.
*B41J 2/14* (2006.01)
*B41J 2/135* (2006.01)

(52) U.S. Cl. ..... 347/47; 347/45

(58) Field of Classification Search ..... 347/45, 347/47

See application file for complete search history.

(56) References Cited

U.S. PATENT DOCUMENTS 6,000,783 A * 12/1999 Takemoto et al. ..... 347/45
6,592,206 B1 * 7/2003 Suzuki et al. ..... 347/45

FOREIGN PATENT DOCUMENTS

| | | |
|---|---|---|
| JP | HEI 5-201000 | 8/1993 |
| JP | 3044729 | 3/2000 |
| JP | 3060526 | 4/2000 |

* cited by examiner

*Primary Examiner*—An H Do
(74) *Attorney, Agent, or Firm*—Reed Smith LLP

(57) ABSTRACT

An inkjet printhead is disclosed which has a cavity unit. The cavity unit includes: a nozzle film in which a plurality of ink-ejecting nozzles are formed; a first plate member which is attached to the nozzle film on a first side face thereof, and in which a through-hole is formed for use in formation of each nozzle in the nozzle film; and a second plate member which is attached to the nozzle film on a second side face thereof which is opposite to the first side face. The second plate member is substantially identical at least in linear thermal expansion to the first plate member, and includes an opening which is larger than each nozzle, and which is disposed at a position corresponding to a position of each nozzle.

13 Claims, 5 Drawing Sheets

INKJET PRINTHEAD WITH SANDWICHED NOZZLE FILM AND METHOD OF MANUFACTURING THE SAME

This application is based on Japanese Patent Application No. 2004-274457 filed Sep. 22, 2004, the content of which is incorporated hereinto by reference.

CROSS-REFERENCE TO RELATED APPLICATIONS

Not Applicable.

BACKGROUND OF THE INVENTION

1. Field of the Invention

The invention relates to an inkjet printhead and a method of manufacturing the inkjet printhead.

2. Description of the Related Art

Typically, an inkjet printhead is constructed to eject ink droplets onto the surface of a print medium such as a print paper, to thereby print or record the desired image on the print medium.

In addition, an inkjet printhead is in general manufactured such that an ink repellent coating or hydrophobic coating is applied to and formed on an area of the inkjet printhead which faces or confronts a print medium, for preventing unwanted attachment of ink droplets to the area.

Conventionally, in manufacturing an inkjet printhead, a hydrophobic coating is applied to and formed on a nozzle-containing face or nozzle face of the inkjet printhead for avoiding unwanted attachment of ink droplets to the nozzle face. The inkjet printhead includes a nozzle film, one of both faces of which faces a print medium and which contains a plurality of nozzles. The one face is referred to as "nozzle face."

Such a hydrophobic coating tends to be easily scratched or damaged due to sliding contact occurring between the hydrophobic coating and an edge of a warped print paper or a jammed print paper. The event is referred to as "paper-caused abrasion" in the art.

If the hydrophobic coating is damaged in areas thereof which are in the vicinity of the nozzles, then ink droplets are attached to the areas surrounding the nozzles, resulting in drawbacks such as miss-firing (non-firing, jet misdirection, or the like) of ink droplets, or contamination of the surface of a print paper with ink droplets.

Under these circumstances, techniques have been previously proposed for preventing the hydrophobic coating which has been applied to the nozzle face, from being damaged due to contact with a print paper or the like. These techniques include a technique of countersinking or recessing the nozzle film in the vicinity of the nozzles, and a technique of attaching a separate member (protective plate) to the nozzle face. See Japanese Patent No. 3060526 and Japanese Patent Publication No. Hei 5-201000, for example.

BRIEF SUMMARY OF THE INVENTION

As described above, a conventional process of creating recesses in the nozzle film in the vicinity of the nozzles requires the implementation of a countersinking process for the nozzle film using a laser beam on a nozzle-by-nozzle basis, for example. The countersinking process causes an increase in the number of steps required for manufacturing the nozzle film, because the countersinking process requires an additional step of locating and directing the laser beam on a nozzle-by-nozzle basis, for example.

Therefore, the conventional process of countersinking the nozzle film in the vicinity of the nozzles tends to cause a decrease in the manufacturing efficiency and an increase in the manufacturing cost.

In addition, when a separate member is required to be attached to the nozzle film for preventing the nozzle face from being scratched or damaged due to the paper-caused abrasion, if the nozzle film is machined to form the nozzles therein using a laser beam after the attachment of the separate member to the nozzle film, then there may occur a difference in the amount of thermal expansion between the nozzle film and the separate member.

Such a thermal expansion may cause warp or distortion of the nozzle film.

Moreover, conventionally, a hydrophobic coating is in general applied to the nozzle film over the entire area of the nozzle face. For this reason, the hydrophobic coating is unavoidably formed also over an area of the nozzle film which is disposed apart from a nozzle array. As a result, it is practically difficult to attach a separate member (protective plate) to the nozzle face after completion of the formation of the hydrophobic coating on the nozzle face.

Furthermore, a conventional technique, whether is a technique of countersinking the nozzle film itself for creating recesses in the nozzle film in the vicinity of the nozzles, or a technique of later attaching a separate member (protective plate) to the nozzle film, confronts practical difficulties in implementation.

These difficulties are invited, not to mention, when the plurality of nozzles are disposed close to each other, and even when these nozzles are so dispersed to each other that adjacent ones of the nozzles has a relatively large clearance between the adjacent ones.

On the other hand, machining the nozzle film using a laser beam to form the plurality of nozzles in the nozzle film requires a step of locating the incident position of the laser beam to the nozzle film on a nozzle-by-nozzle basis.

However, conventionally, no member for assisting the locating action of the laser beam is attached to the nozzle film, resulting in difficulties in forming the nozzles.

It is therefore an object of the present invention to provide an inkjet printhead and a method of manufacturing the same, with an enhanced easiness-to-machine and accuracy of machining.

According to a first aspect of the invention, an inkjet printhead is provided which includes a cavity unit.

The cavity unit includes:

a nozzle film in which a plurality of ink-ejecting nozzles are formed;

a first plate member which is attached to the nozzle film on a first side face thereof, and in which a through-hole is formed for use in formation of each nozzle in the nozzle film; and a second plate member which is attached to the nozzle film on a second side face thereof which is opposite to the first side face.

The second plate member is substantially identical at least in linear thermal expansion to the first plate member, and includes an opening which is larger than each nozzle, and which is disposed at a position corresponding to a position of each nozzle.

This inkjet printhead provides an enhanced easiness to form the nozzles, as compared with when the nozzles are required to be formed using a laser beam without using through-holes formed in the first plate member.

Additionally, this inkjet printhead, even though a sandwich structure in which the nozzle film is sandwiched between the first and second plate members is heated later, does not cause any influential difference between the first and second plate members, resulting in the avoidance of the sandwich structure from being bent due to heat applied thereto.

Still additionally, this inkjet printhead, irrespective of the second plate member being located in front of the nozzle film, allows the formation of a hydrophobic coating on the second side face (front side face) of the nozzle film around the nozzles, owing to the openings being formed properly in the second plate member.

According to a second aspect of the present invention, a method of manufacturing an inkjet printhead including a cavity unit is provided. The cavity unit has: a nozzle film in which a plurality of ink-ejecting nozzles are disposed; and a first plate member in which a through-hole is disposed for use in formation of each nozzle in the nozzle film.

This method of manufacturing the inkjet printhead includes:

a first step of attaching a second plate member to the nozzle film on a first side face thereof which is opposite to a second side face thereof on which the first plate member is attached to the nozzle film, thereby forming a sandwich structure in which the nozzle film is sandwiched between the first and second plate members, wherein the second plate member is substantially identical at least in linear thermal expansion to the first plate member, and wherein the second plate member includes an opening which is larger than each nozzle, and which is disposed at a position corresponding to a position of the nozzle;

a second step of performing ink repellent treatment for the sandwich structure over an area covering an inside surface of the opening of the second plate member, the second step being implemented on a side of the second plate member; and a third step of, after implementation of the second step, forming each nozzle in the nozzle film by laser beam machining performed through the opening, the third step being implemented on a side of the first plate member.

This method achieves both the formation of the second plate member as a protective plate for protecting a nozzle face of the nozzle film, and the implementation of the ink repellent treatment on the front side of the second plate member (one of both side faces of the second plate member which faces a print medium), so as to cover even the areas within the openings.

Further, this method, because is practiced with the nozzle film being sandwiched between the first and second plate members identical at least in the linear thermal expansion, causes no substantial difference in thermal stress between the first and second plate members, even though the sandwich structure is heated by the laser beam machining for forming the nozzles.

Therefore, this method, when practiced, suppresses the sandwich structure from being bent due to the heat.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
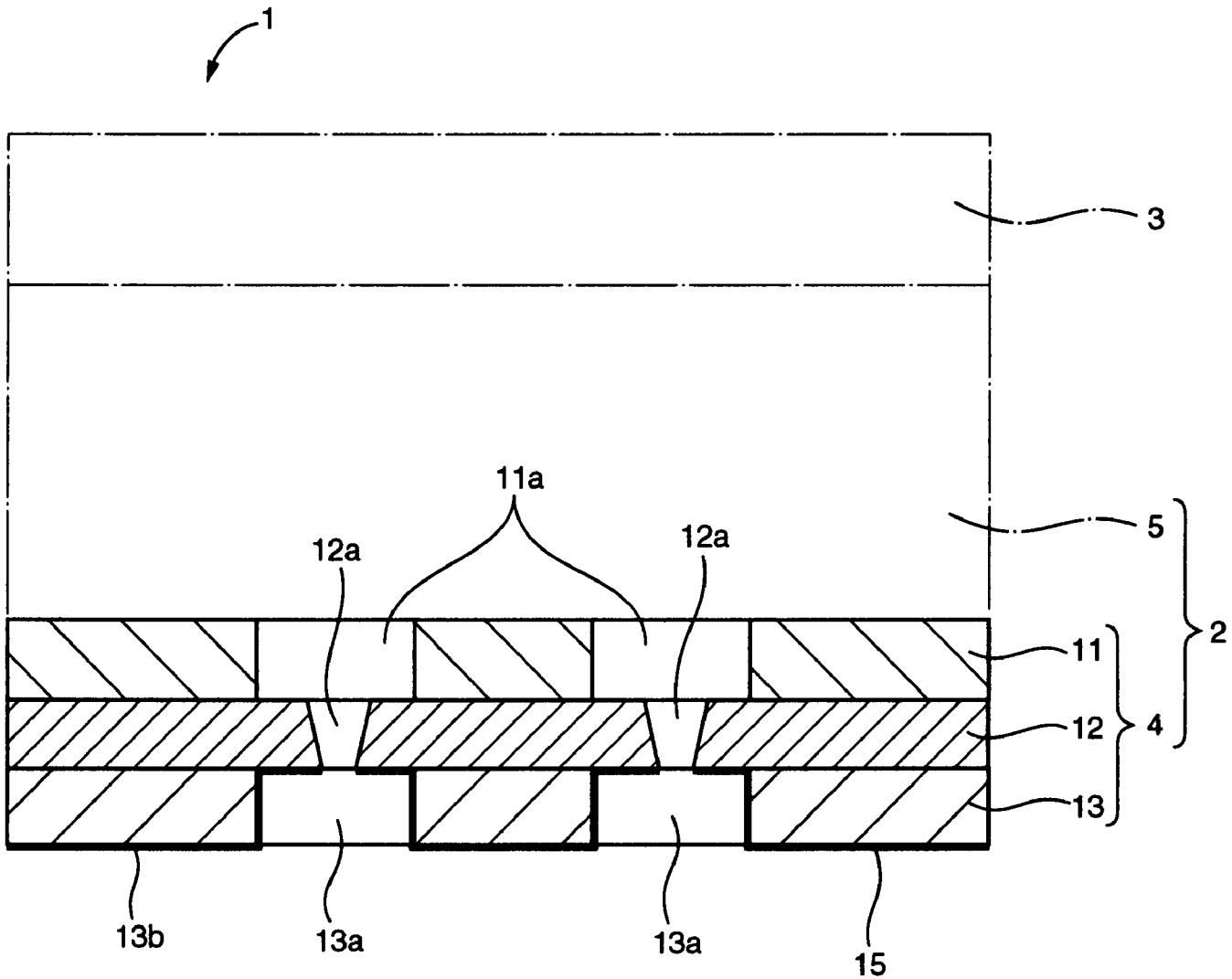
FIG. 1 is a cross section schematically illustrating an inkjet printhead in accordance with a first embodiment of the present invention.

The object mentioned above may be achieved according to any one of the following modes of this invention.

These modes will be stated below so as to be sectioned and numbered, and so as to depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the modes of the invention in such a dependent form as to depend from the other mode or modes does not exclude the possibility that the technological features set forth in a dependent-form mode become independent of those set forth in the corresponding depended mode or modes and to be removed therefrom. It should be interpreted that the technological features set forth in a dependent-form mode is allowed to become independent, where appropriate.

(1) An inkjet printhead including a cavity unit, the cavity unit including:

a nozzle film in which a plurality of ink-ejecting nozzles are formed;

a first plate member which is attached to the nozzle film on a first side face thereof, and in which a through-hole is formed for use in formation of each nozzle in the nozzle film; and a second plate member which is attached to the nozzle film on a second side face thereof which is opposite to the first side face, the second plate member being substantially identical at least in linear thermal expansion to the first plate member, and including an opening which is larger than each nozzle, and which is disposed at a position corresponding to a position of each nozzle.

The inkjet printhead according to the above mode (1) is so structured as to allow the formation of the nozzles in the nozzle film by the laser beam machining performed on the side of the first plate member and through the respective through-holes previously-formed in the first plate member. During the formation, the first plate member functions as a guide for assisting the locating action of the laser beam on a nozzle-by-nozzle basis.

For these reasons, the inkjet printhead according to the above mode (1) provides an enhanced easiness to form the nozzles, as compared with when the nozzles are required to be formed by a laser beam without using through-holes formed in the first plate member.

Further, the inkjet printhead according to the above mode (1) is structured such that the nozzle film is sandwiched between the first and second plate members. These first and second plate members are approximately identical at least in the linear thermal expansion to each other.

As a result, the inkjet printhead, even though the sandwich structure in which the nozzle film is sandwiched between the first and second plate members is heated later, does not cause any influential difference between the first and second plate members. Therefore, the inkjet printhead avoids the sandwich structure from being bent due to heat applied thereto.

In this context, the term "linear thermal expansion" may be interpreted to mean the coefficient of liner thermal expansion of each plate member, or may be interpreted to mean the product of the coefficient of liner thermal expansion and the length, of each plate member.

In addition, the inkjet printhead according to the above mode (1) is so structured as to allow the formation of a hydrophobic coating on a front side face which is one of both side faces of the second plate member that faces a print medium, after the second plate member has been attached to the nozzle film.

Therefore, the inkjet printhead according to the above mode (1), if is manufactured in the above manner, avoids the hydrophobic coating from encumbering the action of bonding the second plate member and the nozzle film together.

Further, the inkjet printhead according to the above mode (1) is structured such that an opening is formed in the second plate member at a position corresponding to the position of each nozzle with a size larger than each nozzle.

Therefore, the inkjet printhead according to the above mode (1) prevents the second plate member from encumbering the action of forming the nozzles by the laser beam machining.

Additionally, the inkjet printhead according to the above mode (1) is structured such that an area of a front side face of the nozzle film, which surrounds each nozzle, is exposed to within a corresponding one of openings, owing to the relationship in dimension between each nozzle and each opening. The front side face is one of both side faces of the nozzle film which is located on the side of a print medium.

Therefore, the inkjet printhead according to the above mode (1), when an ink repellent or hydrophobic material is applied to the second plate member for forming an ink repellent coating or hydrophobic coating on the front side face of the second plate member, enables the formation of the hydrophobic coating not only in the areas inside the openings but also in the areas of the front side face of the nozzle film, which surround the nozzles.

As a result, the inkjet printhead according to the above mode (1), irrespective of the second plate member being located in front of the nozzle film, allows the formation of the hydrophobic coating on the front side face of the nozzle film around the nozzles, owing to the openings being formed properly in the second plate member.

(2) The inkjet printhead according to mode (1), wherein the cavity unit further includes a remaining element which is attached to the first plate member, thereby allowing the second plate member to function as a protective plate for protecting the nozzle film.

In the inkjet printhead according to the above mode (2), the second plate member, which is usable for machining the nozzle film for forming the nozzles using a laser beam, and which is also usable for forming the hydrophobic coating, functions as a protective plate for protecting the nozzle film.

(3) The inkjet printhead according to mode (1) or (2), wherein the first plate member includes an attachment surface for attachment to the nozzle film, the second plate member includes an attachment surface for attachment to the nozzle film, and the first plate member, the nozzle film, and the second plate member are bonded together to form a sandwich structure in which the nozzle film is sandwiched between the first and second plate members, by laminating the first plate member, the nozzle film, and the second plate member with one another, in a direction of lamination allowing the attachment surface of the first plate member to face the first side face of the nozzle film, and allowing the attachment surface of the second plate member to face the second side face of the nozzle film, and by heating a laminate of the first plate member, the nozzle film, and the second plate member while being pressed one another in the direction of lamination.

For manufacturing the inkjet printhead according to the above mode (3), a laminate is formed by sandwiching the nozzle film on its both side faces between the first and second plate members, and then the laminate is heated under pressure acting in a direction of lamination, to thereby manufacture the sandwich structure.

If the laminate is heated with the first and second plate members being different in the coefficient of linear thermal expansion from the nozzle film which is sandwiched between these plate members, then there occur thermal stresses between the first plate member and the nozzle film and between the second plate member and the nozzle film, respectively.

The inkjet printhead according to the above mode (3) is structured such that the first and second plate members are substantially identical at least in the linear thermal expansion to each other.

Therefore, the inkjet printhead according to the above mode (3), even though there are differences in the linear thermal expansion between the first and second plate members and the nozzle film, avoids the laminate from being warped due to a difference in thermal stress resulting from heat applied to the laminate.

(4) The inkjet printhead according to any one of modes (1)-(3), wherein the nozzle film is a synthetic resin plate, and the first and second plate members are metal plates substantially identical in material and thickness to each other.

In the inkjet printhead according to the above mode (4), the first and second plate members are both made of metal, and are identical in material and thickness to each other. Therefore, the inkjet printhead makes it easier to prepare the first and second plate members identical at least in the linear thermal expansion.

(5) The inkjet printhead according to any one of modes (1)-(3), wherein the nozzle film is a synthetic resin plate, the first plate member is a metal plate, and the second plate member is a synthetic resin plate.

In the inkjet printhead according to the above mode (5), the second plate member is made of synthetic resin. On the other hand, a case exists where, for wiping off the inkjet printhead after being purged, a wiper or blade is required to be brought into sliding contact with the second plate member on its front side face which faces a print medium.

In this case, when the inkjet printhead according to the above mode (5) is practiced, the wiper is brought into sliding contact with the second plate member more softly than when the second plate member is alternatively made of metal. Therefore, the inkjet printhead more easily provides an extended lifetime of the wiper.

(6) The inkjet printhead according to mode (5), wherein the second plate member is a liquid crystal polymer plate.

In the inkjet printhead according to the above mode (6), the second plate member is made of liquid crystal polymer. On the other hand, in general, liquid crystal polymer is material adjustable in the coefficient of linear thermal expansion within a wider range extending approximately between 0/° C.-$20\times10^{-6}$/° C.

For this reason, the inkjet printhead according to the above mode (6) allows the selection of a specific kind of metal forming the first plate member which is to have substantially the same coefficient of linear thermal expansion as that of the second plate member, from a plurality of kinds of metals which are widely varied in the coefficient of linear thermal expansion.

Therefore, the inkjet printhead according to the above mode (6) provides an improved flexibility of selecting the kind of metal forming the first plate member.

(7) The inkjet printhead according to any one of modes (1)-(6), wherein the through-hole and the opening are formed in the first and second plate members, respectively, so as to be opposed in position and substantially identical in size, to each other.

The inkjet printhead according to the above mode (7) is manufactured without requiring distinct fabrication, management, or handling of the first and second plate member, from each other.

Therefore, the inkjet printhead according to the above mode (7) makes it easier to simplify the steps required for manufacturing the inkjet printhead, to thereby improve the efficiency of manufacturing the inkjet printhead.

(8) The inkjet printhead according to any one of modes (1)-(7), wherein the opening is formed commonly for a group of adjacent ones of the plurality of nozzles.

The inkjet printhead according to the above mode (8) allows the number of openings formed in the second plate member, to be smaller than when the openings are formed in the second plate member for the nozzles in one-to-one correspondence.

Therefore, the inkjet printhead according to the above mode (8) makes it easier to machine the second plate member for forming the openings, for example.

(9) The inkjet printhead according to any one of modes (1)-(8), wherein the opening includes a plurality of openings which are formed for the plurality of nozzles, respectively.

The inkjet printhead according to the above mode (9) is structured such that the openings are used together with the through-holes for the formation of the nozzles by the laser beam. Therefore, the inkjet printhead makes it easier to form the nozzles accurately in dimension, by using the openings for location on a nozzle-by-nozzle basis.

(10) The inkjet printhead according to any one of modes (1)-(9), wherein a sandwich structure is formed by sandwiching the nozzle film between the first and second plate members, the sandwich structure including an ink repellent coating formed on the second plate member over an area covering an inside surface of the opening of the second plate member.

The inkjet printhead according to the above mode (10) is structured, such that an ink repellent coating or hydrophobic coating is formed on the sandwich structure on the side of the second plate member, so as to cover even the inside surface of each opening in the second plate member.

On the other hand, each opening in the second plate member is larger than each nozzle in the nozzle film, and therefore the areas of a front side face of the nozzle film (one of its both surfaces which contacts the second plate member), which surround the nozzles, are exposed to within the openings.

As a result, the inkjet printhead according to the above mode (10) makes it easier to form the ink repellent coating so as to cover not only the front side face of the second plate member and the inner circumferential surfaces of the openings, but also the areas of the front side face of the nozzle film, which surround the nozzles.

On the other hand, the inkjet printhead according to the above mode (10) may be manufactured such that the ink repellent coating is formed over an area of the front side face of the nozzle film in which the nozzles will be later formed, before the formation of the nozzles in the nozzle film by the laser beam machining.

In this case, the ink repellent coating is avoided from coating the interior surfaces of nozzle-forming channel in the nozzle film, differently from a case where the ink repellent coating is formed after the laser beam machining.

(11) A method of manufacturing an inkjet printhead including a cavity unit having: a nozzle film in which a plurality of ink-ejecting nozzles are disposed; and a first plate member in which a through-hole is disposed for use in formation of each nozzle in the nozzle film, the method including:

a first step of attaching a second plate member to the nozzle film on a first side face thereof which is opposite to a second side face thereof on which the first plate member is attached to the nozzle film, thereby forming a sandwich structure in which the nozzle film is sandwiched between the first and second plate members, wherein the second plate member is substantially identical at least in linear thermal expansion to the first plate member, and wherein the second plate member includes an opening which is larger than each nozzle, and which is disposed at a position corresponding to a position of each nozzle;

a second step of performing ink repellent treatment for the sandwich structure over an area covering an inside surface of the opening of the second plate member, the second step being implemented on a side of the second plate member; and a third step of, after implementation of the second step, forming each nozzle in the nozzle film by laser beam machining performed through the through-hole, the third step being implemented on a side of the first plate member.

Once the method according to the above mode (11) is implemented, the sandwich structure is fabricated in the first step, and subsequently, the ink repellent treatment is performed in the second step for the fabricated sandwich structure, on the side of the second plate member, so as to cover even the areas within openings of the second plate member.

Thereafter, the nozzles are formed in the third step, in the nozzle film, with the laser beam machining performed through the through-holes, on the side of the first plate member.

Therefore, the method according to the above mode (11) achieves both the formation of the second plate member as a protective plate for protecting a nozzle face of the nozzle film, and the implementation of the ink repellent treatment on the front side of the second plate member (one of both side faces of the second plate member which faces a print medium), so as to cover even the areas within the openings.

Further, the method according to the above mode (11), because is practiced with the nozzle film being sandwiched between the first and second plate members identical at least in the linear thermal expansion, causes no substantial difference in thermal stress between the first and second plate members, even though the sandwich structure is heated by the laser beam machining for forming the nozzles.

Therefore, the method according to the above mode (11), when practiced, suppresses the sandwich structure from being bent due to the heat.

(12) The method according to mode (11), wherein the cavity unit further includes a remaining element in addition to the nozzle film, the first plate member, and the second plate member, and the method further including a fourth step of, after implementation of the third step, attaching the remaining element of the cavity unit to the sandwich structure on the first plate member, thereby allowing the second plate member to function as a protective plate for protecting the nozzle film.

Once the method according to the above mode (12) is practiced, the second plate member, which is usable for machining the nozzle film for forming the nozzles using a laser beam, and which is also usable for forming the hydrophobic coating, functions as a protective plate for protecting the nozzle film.

(13) The method according to mode (11) or (12), wherein the first step includes the steps of:

applying thermosetting adhesive to attachment surfaces of the first and second plate members for allowing attachment with the nozzle film;

laminating the first plate member, the nozzle film, and the second plate member with one another, in a direction of lamination allowing the attachment surface of the first plate member to face the first side of the nozzle film, and allowing the attachment surface of the second plate member to face the second side of the nozzle film; and heating the first plate member, the nozzle film, and the second plate member while pressing in the direction of lamination, thereby forming the sandwich structure.

Once the method according to the above mode (13) is implemented, a laminate is formed by sandwiching the nozzle film on its both side faces between the first and second plate members, and then the laminate is heated under pressure acting in a direction of lamination, to thereby manufacture the sandwich structure.

If the laminate is heated with the first and second plate members being different in the coefficient of linear thermal expansion from the nozzle film which is sandwiched between these plate members, then there occur thermal stresses between the first plate member and the nozzle film and between the second plate member and the nozzle film, respectively.

The method according to the above mode (13) is practiced such that the first and second plate members are substantially identical at least in the linear thermal expansion to each other.

Therefore, the method according to the above mode (13), even though there are differences in the linear thermal expansion between the first and second plate members, and the nozzle film, avoids the laminate from being warped due to a difference in thermal stress resulting from heat applied to the laminate.

Several presently preferred embodiments will be described in detail by reference to the drawings in which like numerals are used to indicate like elements throughout.

Referring now to FIG. 1, an inkjet printhead 1 in accordance with a first embodiment of the present invention is schematically illustrated in sectional view.

As illustrated in FIG. 1, the inkjet printhead 1, which is for use in the printing of a print media such as a print paper by ejecting ink thereonto, is constructed to include a cavity unit 2 which forms ink supply passages for supplying ink to a plurality of nozzles 12*a*, and a piezoelectric actuator 3 for ejecting ink through the plurality of nozzles 12*a*.

The cavity unit 2 is configured to include, as one of its elements, on a side of a print media, a sandwich-structured body 4 which is formed by attaching a second plate member 13 to a first plate member 11, via a nozzle film 12.

The plurality of nozzles 12*a* are formed in and through the nozzle film 12. Each nozzle 12*a* is tapered off toward the second plate member 13. The first plate member 11 includes a plurality of through-holes 11*a*, each of which is for use in the formation of each nozzle 12*a* by an eximer laser beam machining, and each of which is formed in the first plate member 11 at a position corresponding to that of each nozzle 12*a*. The nozzle film 12 is made of polyimide-resin whose coefficient of linear thermal expansion is $20\times10^{-6}/°$ C.-$25\times10^{-6}/°$ C.

The first and second plate members 11, 13 are made of metals identical in material or kind and identical in thickness, to each other. Therefore, both plate members 11, 13 are identical in the coefficient of linear thermal expansion to each other. In the present embodiment, both plate members 11, 13 are made of SUS304 whose coefficient of linear thermal expansion is in the neighborhood of $17\times10^{-6}/°$ C.

The second plate member 13 includes a plurality of openings 13*a*, each of which is larger than each nozzle 12*a* (i.e., an inner diameter of one of both ends of each nozzle 12*a* which is located closer to the second plate member 13), and each of which is formed in the second plate member 13 in the form of a cylindrical hole at a position corresponding to that of each nozzle 12*a*.

Each opening 13*a* is circular in section and is coaxial with a corresponding one of the nozzles 12*a*. The plurality of openings 13*a* formed in the second plate member 13 are provided on a nozzle-by-nozzle basis.

The ink repellant treatment has been implemented for at least an inside surface of each opening 13*a* of the second plate member 13. In the present embodiment, an ink repellant coating or hydrophobic coating 15 has been formed over a front side face 13*b* of the second plate member 13 throughout.

To the first plate member 11 of the sandwich-structured body 4, a laminated structure 5 is attached at its first side face. The laminated structure 5 is a remaining element of the cavity unit 2, and is constructed by laminating and attaching a plurality of metal plates one another. To a second side face of the laminated structure 5 which is opposite to the first side face, a piezoelectric actuator 3 is attached.

That is to say, the cavity unit 2 is constructed so as to include both the sandwich-structured body 4 and the laminated structure 5. The inkjet printhead 1 is configured to further include the piezoelectric actuator 3 attached to the laminated structure 5 at its second side face.

By referring to FIGS. 2A-2C, a method of manufacturing the inkjet printhead 1 will be described.

First Step

Figure 2A:
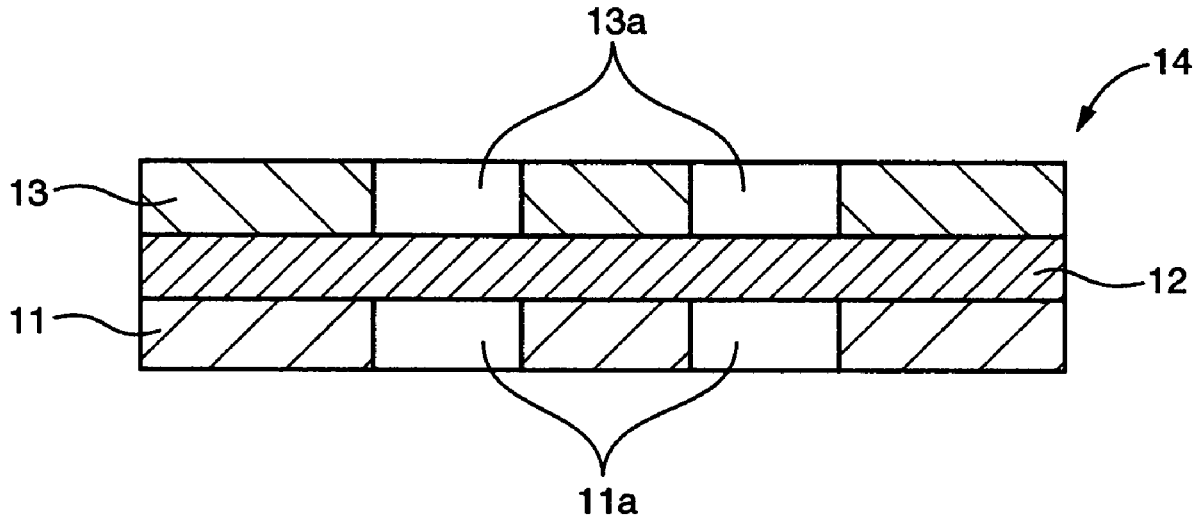
FIGS. 2A-2C are cross sections for step-by-step explanation of a method of manufacturing the inkjet printhead illustrated in FIG. 1.

In a first step, as shown in FIG. 2A, the nozzle film 12 is attached at its first side face to the first plate member 11 in which the through-holes 11*a* have been previously formed for use in later formation of the nozzles 12*a*. The second plate member 13 is attached to the nozzle film 12 at its second side face. As a result, a sandwich structure 14 corresponding to the sandwich-structured body 4 is manufactured.

Before both plate members 11, 13 are attached to the nozzle film 12, adhesive is applied to attachment surfaces of the plate members 11, 13 to a predetermined thickness by a transfer method.

The second plate member 13 is made of metal having the same material and thickness (75 μm, for example) as those of the first plate member 11, and is approximately identical in the coefficient of linear thermal expansion to the first plate member 11.

Further, both plate members 11, 13 are sized to have equal lengths. Consequently, both plate members 11, 13 are substantially identical in the total amount of thermal expansion, which is defined to be equal to the product of the length of each plate member 11, 13 and the coefficient of liner thermal expansion of each plate member 11, 13.

Each opening 13*a* has been formed in the second plate member 13 by a punching method, so as to be larger than each nozzle 12*a*, and is located at a position corresponding to that of each nozzle 12*a*.

That is to say, both plate members 11, 13 are identical to each other, and they have no difference. On the other hand, the nozzle film 12 is a film made of synthetic resin (polyimide, for example).

Each through-hole 11*a* has been formed in the first plate member 11 in the form of a cylindrical hole by a punching method, so as to be located at a position corresponding to that of each nozzle 12*a*, and coaxial with the corresponding nozzle 12*a*. Each opening 13*a* has been formed in the second plate member 13 at a position facing a corresponding one of the through-holes 11*a* of the first plate member 11, so as to be identical in size (diameter) to the corresponding through-hole 11*a*. Each through-hole 11*a* is larger than a corresponding one of the nozzles 12*a* (i.e., an inner diameter of one of both ends of the corresponding nozzle 12*a* which is located closer to the first plate member 13).

As described above, for manufacturing the sandwich structure 14, thermosetting adhesive is applied to the first and second plate members 11, 13 on their attachment surfaces to the nozzle film 12, respectively. The first plate member 11, the nozzle film 12, and the second plate member 13 are laminated with one another, such that the attachment surface of the first plate member 11 faces the first side face of the nozzle film 12, while the attachment surface of the second plate member 13 faces the second side face of the same nozzle film 12.

The first plate member 11, the nozzle film 12, and the second plate member 13 are heated while being pressed one another in a direction of lamination, whereby the sandwich structure 14 is manufactured.

Owing to the presence of the through-holes 11*a* of the first plate member 11, mere attachment or fixation of the nozzle film 12 only to the first plate member 11 of the first and second plate members 11, 13 makes it easier to form the nozzles 12*a* in the nozzle film 12.

However, attaching different materials, such as a combination of the first plate member 11 and the nozzle film 12 to each other, by the use of thermosetting adhesive, creates a difference in the amount of expansion therebetween due to heat applied thereto for fixation. As a result, warp or deflection can occur in the combination of these materials.

In contrast, in the present embodiment, the nozzle film 12, which is a synthetic-resin film (polyimide is employed in the present embodiment) whose coefficient of linear thermal expansion is large, is sandwiched between the first and second plate members 11, 13 which are two metal plates each made of a material smaller in coefficient of linear thermal expansion than that of the nozzle film 12, whereby the sandwich structure 14 is manufactured.

Therefore, in the present embodiment, thermal stress, which can cause warp or deflection, is balanced between both side faces of the nozzle film 12, whereby the sandwich structure 14 is obtained without warp or deflection due to change in temperature. The thus-obtained sandwich structure 14 provides an increased overall rigidity, and then provides improved mechanical properties, when compared with a case in which the nozzle film 12 is attached and fixed only to the first plate member 11. As a result, the thus-obtained sandwich structure 14 provides higher functionality.

Further, in the present embodiment, although the total number of components is larger than when the nozzle film 12 is attached and fixed only to the first plate member 11, the number of kinds of components constituting the inkjet printhead 1 remains unchanged, due to both plate members 11, 13 being identical in material and shape to each other. Therefore, the present embodiment improves heat resistivity in the inkjet printhead 1 without inviting a decrease in manufacturing efficiency due to an increase in the number of kinds of components.

Second Step

Figure 2B:
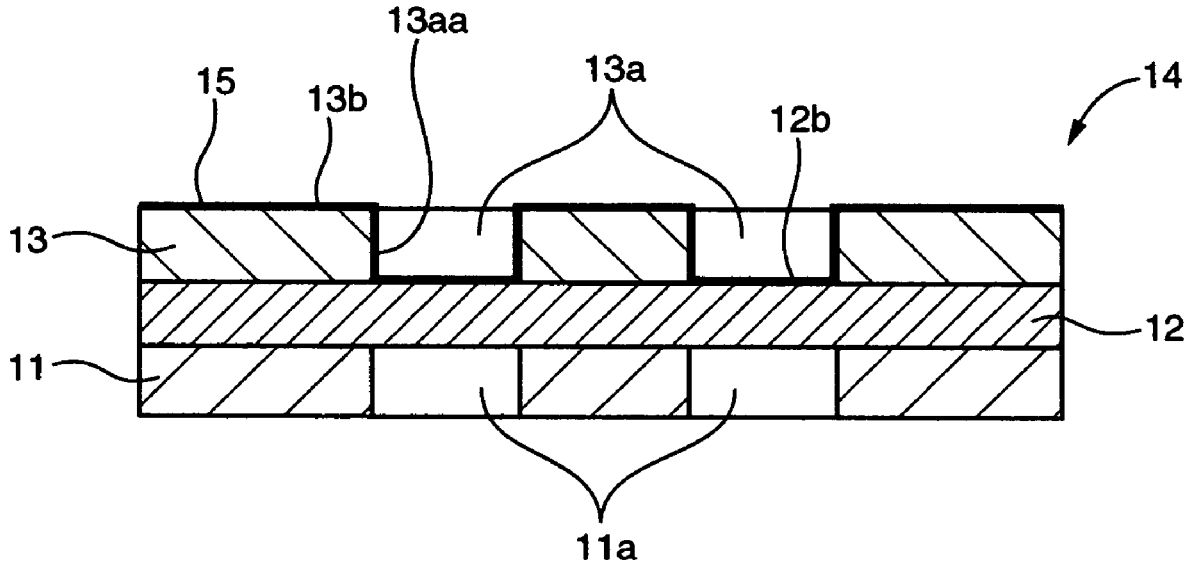

In a second step, as shown in FIG. 2B, the ink repellant treatment is implemented for the sandwich structure 14 on the side of the second plate member 13 throughout. As a result, the ink repellant coating 15 is formed on a portion including even the inside surface of each opening 13*a* of the second plate member 13. The ink repellant coating 15 is formed not only over the front side face 13*b* of the second plate member 13 but also over the inside surface of each opening 13*a*, namely, an inner circumferential surface 13*aa* of each opening 13*a* and an area 12*b* of the surface of the nozzle film 12 which is exposed to within each opening 13*a*.

As mentioned above, in the present embodiment, the ink repellant coating 15 is formed even in the inside surface of each opening 13*a*. On the other hand, as described later by referring to FIG. 2C, each nozzle 12*a* is formed in the nozzle film 12 so as to be exposed to within the inside surface of each opening 13*a*, and so as not to be exposed to the front side face 13*b* of the second plate member 13.

Therefore, in the present embodiment, when the inkjet printhead 1 is actually in use, even though friction occurs between the front side face 13*b* and the face of a print paper, the ink repellant coating 15 is prevented from being damaged in the vicinity of each nozzle 12*a*.

Third Step

Figure 2C:
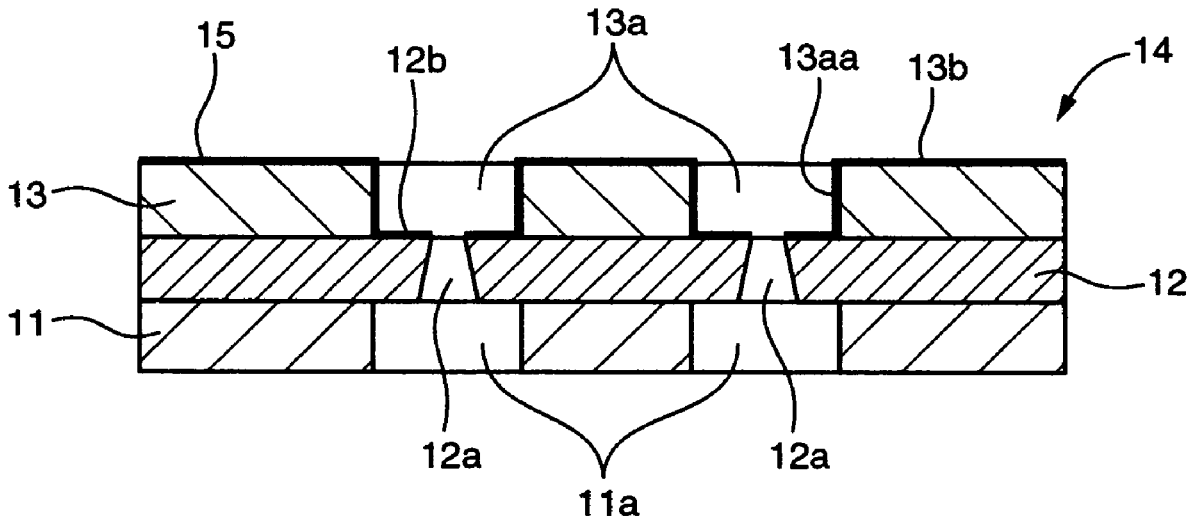

In a third step following the second step, as shown in FIG. 2C, each nozzle 12*a* is formed in the nozzle film 12 by the eximer laser beam machining performed through each through-hole 11*a* on the side of the first plate member 11.

The laser beam machining is performed for each through-hole 11*a* while the position of an opening of each through-hole 11*a* is being monitored by an image recognition processing using the microscopic image of each through-hole 11*a*. Accordingly, the relationship in position between each through-hole 11*a* and each nozzle 12*a* becomes constant regardless of the position of each nozzle 12*a*.

The ink repellant coating 15, which is formed on the nozzle film 12 prior to the formation of each nozzle 12*a* in the nozzle film 12, is shaped such that the ink repellant coating 15 covers the nozzle film 12 so as to extend exactly to an open end of each nozzle 12*a*.

In the present embodiment, the laser beam machining is implemented for the sandwich structure 14 while heating the sandwich structure 14 which is configured to cause no warp or deflection due to change in temperature. Therefore, the plurality of nozzles 12*a* are formed equally not only in shape and size but also in the direction of the central axis of each nozzle 12*a*. As a result, the sandwich structure 14 is provided to have the plurality of nozzles 12*a* equal in the ink firing property.

As shown in FIG. 2C, because of the directivity of the machining of each nozzle 12*a*, each nozzle 12*a* is formed as a truncated cone or tapered hole which becomes gradually smaller in cross section of an inner opening area, when going in a direction from the side of the first plate member 11 toward the side of the second plate member 13.

Fourth Step

In a fourth step following the third step, in order to allow the second plate member 13 to function as a protective plate of the nozzle film 12, as shown in FIG. 1, the laminated structure 5 is attached at its first side face to the sandwich structure 14 at its side of the first plate member 11. The laminated structure 5 is the remaining element of the cavity unit 2 (obtained by excluding the first and second plate members 11, 13, and the nozzle film 12 from a plurality of elements constituting the cavity unit 2) (see FIG. 1). To a second side face of the laminated structure 5, the piezoelectric actuator 3 is attached.

Figure 3:
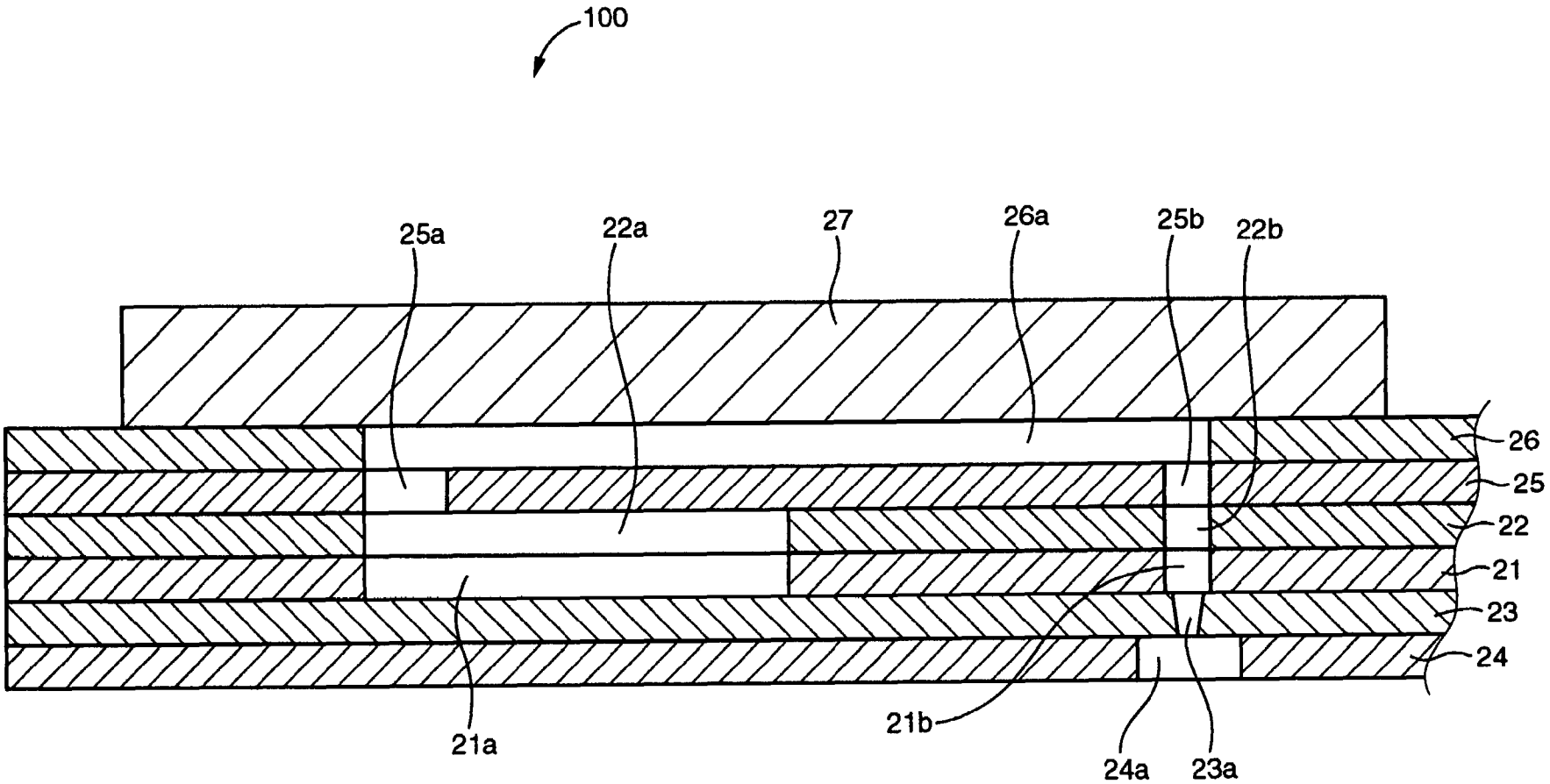
FIG. 3 is a cross section schematically illustrating an inkjet printhead in accordance with a second embodiment of the present invention.

Referring next to FIG. 3, an inkjet printhead 100 in accordance with a second embodiment of the present invention will be described. FIG. 3 illustrates the inkjet printhead 100 in sectional view.

In the inkjet printhead 1 illustrated in FIG. 1, each opening 13*a* and each through-hole 11*a* are manufactured so as to be equal in size and shape to each other. In contrast, in the inkjet printhead 100 illustrated in FIG. 3, each opening and each through-hole are manufactured such that each opening is larger than each through-hole.

The construction of the inkjet printhead 100 illustrated in FIG. 3, because is basically common to that of the inkjet printhead 1 illustrated in FIG. 1, will be described in greater detail, with respect to the different elements of the inkjet printhead 100 from those of the inkjet printhead 1, without redundant description of the common elements.

Further, the method of manufacturing of the inkjet printhead 100, because is basically common to that of the inkjet printhead 1, will be described in greater detail, with respect to the different elements of the inkjet printhead 100 from those of the inkjet printhead 1, without redundant description of the common elements.

In the inkjet printhead 100 illustrated in FIG. 3, a first plate member is in the form of one of first and second manifold plates 21, 22 having manifold holes 21*a* and 22*a*, respectively, for together constituting a manifold, wherein the one is the first manifold plate 21. In addition, a second plate member is in the form of a cover plate 24 (protective plate) protecting a nozzle face of a nozzle film 23. The nozzle face is defined to contain a plurality of nozzles 23*a* formed in the nozzle film 23.

The first manifold plate 21 includes therein a plurality of through-holes 21*b* for use in the formation of the nozzles 23*a*. The cover plate 24 includes a plurality of openings 24*a* each of which is formed in the cover plate 24 at a position corresponding to that of each nozzle 23*a*. Similarly to the first manifold plate 21, the second manifold plate 22 includes, in addition to the manifold holes 22*a*, a plurality of through-holes 22*b* formed in the second manifold plate 22.

On the second manifold plate 22, a laminate of a supply plate 25 and a cavity plate 26 is superposed. The cavity plate 26 includes therein a plurality of openings 26*a* to eventually form respective pressure chambers. The supply plate 25 includes therein a plurality of first communication holes 25*a* for allowing the openings 26*a* and the manifold holes 22*a* to communicate with each other, and a plurality of second communication holes 25*b* for allowing the opening 26*a* and the through holes 22*b* to communicate with each other.

On the pressure chambers formed with the openings 26*a*, a piezoelectric actuator 27 is disposed which applies pressure to the pressure chambers, on the basis of drive signals supplied to the piezoelectric actuator 27, to thereby eject ink droplets through the nozzles 23*a*.

In the inkjet printhead 100 illustrated in FIG. 3, a sandwich structure similar to that of the first embodiment is manufactured by sandwiching the nozzle film 23 between the first manifold plate 21 and the cover plate 24.

Thereafter, the sandwich structure is attached to a first side face of a laminate formed by laminating and adhesively bonding the plates 22, 25, and 26 one another, to a second side face of which, the piezoelectric actuator 27 is attached. As a result, the inkjet printhead 100 is manufactured.

In the present embodiment, each opening 24*a* included in the cover plate 24 is formed a little larger than that in the first embodiment. For this reason, maintainability in a purging action of the inkjet printhead 100 is improved. This will be described below in greater detail.

For example, there is a case in which ink droplets remain inside each opening 24*a* after the replacement of an ink cartridge which is an ink supply source, or during a purging process implemented at the initial fill of ink, for example. If the cover plate 24 is absent, then the nozzle face can be wiped directly with a blade, without leaving any residual ink on the nozzle face.

However, in the present embodiment, due to each nozzle 23*a* being open within a recessed portion of each opening 24*a* (inside each opening 24*a*), possible residual ink can be removed by pressing onto each nozzle 23*a* a porous member providing an improved absorptivity of ink, after wiping off the surface of the cover plate 24 with the blade.

In the present embodiment, owing to each opening 24*a* being larger than each opening 13*a* in the first embodiment, a proper pressing action of the porous member onto each nozzle 23*a* becomes easier, meaning that the present embodiment is more advantageous than the first embodiment in the efficient removal of residual ink within each opening 24*a*.

In the first embodiment illustrated in FIG. 1, the first and second plate members 11, 13 forming the sandwich structure 14 are constructed using metal plates identical in material and thickness to each other.

On the other hand, because there occurs no problem if only the sandwich structure 14 is not warped due to heat applied thereto during the formation of the nozzles 12*a* in the nozzle film 12, the two plate members 11, 13 between which the nozzle film 12 is sandwiched are enough to be constituted with materials identical at least in the coefficient of linear thermal expansion to each other.

Therefore, in an alternative embodiment of the present invention, the nozzle film 12 is in the form of a synthetic-resin film, the first plate member 11 is in the form of a metal plate, and the second plate member 13 (corresponding to the cover plate 24, in the second embodiment) is in the form of a synthetic-resin film identical in the coefficient of linear thermal expansion to the first plate member 11.

In the second embodiment illustrated in FIG. 3, wiping off the surface of the cover plate 24 (corresponding to the second plate member 13, in the first embodiment) with the blade in sliding contact with the cover plate 24 causes wear of the blade. This tendency is greater when the cover plate 24 is made of metal than when the cover plate 24 is made of synthetic resin. Therefore, manufacturing the cover plate 24 with synthetic resin is advantageous when an extended life of the blade is required.

In this regard, owing to the fact that liquid crystal polymer is a material which can be adjusted with respect to the coefficient of linear thermal expansion approximately in the range of 0/° C.-$20\times10^{-6}$/° C., liquid crystal polymer is preferably employed as a synthetic resin forming the cover plate 24 (corresponding to the second plate member 13, in the first embodiment).

The employment of liquid crystal polymer as a synthetic resin forming the cover plate 24 allows the selection of a specific value within a broader range of the coefficient of linear thermal expansion of the first manifold plate 21 (corresponding to the first plate member 11, in the first embodiment), resulting in an improved flexibility in selecting a material of the manifold plate 21.

More specifically, a material such as metal alloy 42 (alloy with approximately 42% nickel and 58% iron) with higher workability (coefficient of linear thermal expansion: approximately $5\times10^{-6}$/° C.), or SUS 430 with higher resistance of corrosion (coefficient of linear thermal expansion: approximately $10.5\times10^{-6}/°$ C.) can be appropriately selected as the material of the first manifold plate 21, so as to conform with the operating conditions of the inkjet printhead 100 or the properties of ink used.

In the first embodiment illustrated in FIG. 1, the openings 13*a* are disposed in the second plate member 13 on a nozzle-by-nozzle basis.

In contrast, in a further alternative embodiment of the present invention, for enabling a simplified machining of the second plate member 13, openings are disposed in the second plate member 13 on a group-by-group basis, wherein each group is comprised of adjacent ones of the plurality of nozzles 12*a*.

In this embodiment, all the nozzles 12*a* may be constituted so as to be exposed to within a single opening. Alternatively, all the nozzles 12*a* may be constituted so as to be exposed to within each nozzle group, wherein each nozzle group is comprised of a predetermined number of ones of the nozzles 12*a* which is fewer than the total number of the nozzles 12*a*.

For the reasons similar to the first and second embodiments, the employment of this embodiment surely prevents the ink repellant coating 15 from being damaged due to friction between the ink repellant coating 15 and a print paper in the vicinity of the nozzles 12*a*, and further, makes is easier to surely remove residual ink within the openings 13*a*. In these respects, this embodiment is more advantageous than the first and second embodiments.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An inkjet printhead including a cavity unit, the cavity unit comprising:

a nozzle film in which a plurality of ink-ejecting nozzles are formed;

a first plate member which is attached to the nozzle film on a first side face thereof, and in which a through-hole is formed for use in formation of each nozzle in the nozzle film; and a second plate member which is attached to the nozzle film on a second side face thereof which is opposite to the first side face, the second plate member being substantially identical at least in linear thermal expansion to the first plate member, and including an opening which is larger than each nozzle, and which is disposed at a position corresponding to a position of each nozzle.

2. The inkjet printhead according to claim 1, wherein the cavity unit further comprises a remaining element which is attached to the first plate member, thereby allowing the second plate member to function as a protective plate for protecting the nozzle film.

3. The inkjet printhead according to claim 1, wherein the first plate member comprises an attachment surface for attachment to the nozzle film, the second plate member comprises an attachment surface for attachment to the nozzle film, and the first plate member, the nozzle film, and the second plate member are bonded together to form a sandwich structure in which the nozzle film is sandwiched between the first and second plate members, by laminating the first plate member, the nozzle film, and the second plate member with one another, in a direction of lamination allowing the attachment surface of the first plate member to face the first side face of the nozzle film, and allowing the attachment surface of the second plate member to face the second side face of the nozzle film, and by heating a laminate of the first plate member, the nozzle film, and the second plate member while being pressed one another in the direction of lamination.

4. The inkjet printhead according to claim 1, wherein the nozzle film is a synthetic resin plate, and the first and second plate members are metal plates substantially identical in material and thickness to each other.

5. The inkjet printhead according to claim 1, wherein the nozzle film is a synthetic resin plate, the first plate member is a metal plate, and the second plate member is a synthetic resin plate.

6. The inkjet printhead according to claim 5, wherein the second plate member is a liquid crystal polymer plate.

7. The inkjet printhead according to claim 1, wherein the through-hole and the opening are formed in the first and second plate members, respectively, so as to be opposed in position and substantially identical in size, to each other.

8. The inkjet printhead according to claim 1, wherein the opening is formed commonly for a group of adjacent ones of the plurality of nozzles.

9. The inkjet printhead according to claim 1, wherein the opening comprises a plurality of openings which are formed for the plurality of nozzles, respectively.

10. The inkjet printhead according to claim 1, wherein a sandwich structure is formed by sandwiching the nozzle film between the first and second plate members, the sandwich structure comprising an ink repellant coating formed on the second plate member over an area covering an inside surface of the opening of the second plate member.

11. A method of manufacturing an inkjet printhead including a cavity unit having: a nozzle film in which a plurality of ink-ejecting nozzles are disposed; and a first plate member in which a through-hole is disposed for use in formation of each nozzle in the nozzle film, the method comprising:

a first step of attaching a second plate member to the nozzle film on a first side face thereof which is opposite to a second side face thereof on which the first plate member is attached to the nozzle film, thereby forming a sandwich structure in which the nozzle film is sandwiched between the first and second plate members, wherein the second plate member is substantially identical at least in linear thermal expansion to the first plate member, and wherein the second plate member includes an opening which is larger than each nozzle, and which is disposed at a position corresponding to a position of each nozzle;

a second step of performing ink repellant treatment for the sandwich structure over an area covering an inside surface of the opening of the second plate member, the second step being implemented on a side of the second plate member; and a third step of, after implementation of the second step, forming each nozzle in the nozzle film by laser beam machining performed through the through-hole, the third step being implemented on a side of the first plate member.

12. The method according to claim 11, wherein the cavity unit further includes a remaining element in addition to the nozzle film, the first plate member, and the second plate member, and the method further comprising a fourth step of, after implementation of the third step, attaching the remaining element of the cavity unit to the sandwich structure on the first plate member, thereby allowing the second plate member to function as a protective plate for protecting the nozzle film.

13. The method according to claim 11, wherein the first step comprises the steps of:

applying thermosetting adhesive to attachment surfaces of the first and second plate members for allowing attachment with the nozzle film;

laminating the first plate member, the nozzle film, and the second plate member with one another, in a direction of lamination allowing the attachment surface of the first plate member to face the first side of the nozzle film, and allowing the attachment surface of the second plate member to face the second side of the nozzle film; and heating the first plate member, the nozzle film, and the second plate member while pressing in the direction of lamination, thereby forming the sandwich structure.

* * * * *